US012270582B1

(12) United States Patent
Coyle et al.

(10) Patent No.: US 12,270,582 B1
(45) Date of Patent: Apr. 8, 2025

(54) BULBLESS THERMOSTATIC EXPANSION VALVE AND METHOD OF JOINING INSULATED POWER ELEMENT

(71) Applicant: Parker-Hannifin Corporation, Cleveland, OH (US)

(72) Inventors: Eric R. Coyle, Chesterfield, MO (US); Raghujit Prasad Kunapuli, Chesterfield, MO (US)

(73) Assignee: Parker-Hannifin Corporation, Cleveland, OH (US)

( * ) Notice: Subject to any disclaimer, the term of this patent is extended or adjusted under 35 U.S.C. 154(b) by 217 days.

(21) Appl. No.: 18/173,861

(22) Filed: Feb. 24, 2023

Related U.S. Application Data

(60) Provisional application No. 63/356,255, filed on Jun. 28, 2022, provisional application No. 63/334,273, filed on Apr. 25, 2022.

(51) Int. Cl.
*F25B 41/335* (2021.01)

(52) U.S. Cl.
CPC .... *F25B 41/335* (2021.01); *F25B 2341/0683* (2013.01); *F25B 2500/15* (2013.01)

(58) Field of Classification Search
CPC ..... F25B 41/335; F25B 2341/0683; F25B 2500/15
See application file for complete search history.

(56) References Cited

U.S. PATENT DOCUMENTS

| | | | | |
|---|---|---|---|---|
| 3,786,651 | A | 1/1974 | Eschbaugh et al. | |
| 5,361,597 | A | 11/1994 | Hazime et al. | |
| 5,826,438 | A | 10/1998 | Ohishi et al. | |
| 5,961,038 | A * | 10/1999 | Okada | F25B 41/335 236/92 B |
| 6,474,088 | B2 | 11/2002 | Minowa et al. | |

FOREIGN PATENT DOCUMENTS

EP 537776 A1 4/1993

* cited by examiner

*Primary Examiner* — Jonathan Bradford
(74) *Attorney, Agent, or Firm* — Renner, Otto, Boisselle & Sklar, LLP

(57) ABSTRACT

A bulbless thermostatic expansion valve has enhanced joining of the power element to the valve body. The valve body includes an upper extension that extends from a main body portion, an end of the upper extension being crimped into a lip relative to an opposing surface of the main body portion thereby defining a recess that receives a portion of the housing of the power element to the join the power element to the valve body. The lip may be formed by roll forming the end of upper extension of the valve body. The housing of the power element may be a multipart housing including an upper housing and a lower housing, with a diaphragm being secured between the upper housing and the lower housing, and an end of the lower housing is the portion of the housing of the power element that is received within the recess.

20 Claims, 5 Drawing Sheets

BULBLESS THERMOSTATIC EXPANSION VALVE AND METHOD OF JOINING INSULATED POWER ELEMENT

This application claims the benefit of U.S. Application No. 63/356,255, filed Jun. 28, 2022, and U.S. Application No. 63/334,273, filed Apr. 25, 2022, each of which is hereby incorporated herein by reference in its entirety.

FIELD OF INVENTION

The present application relates to bulbless thermostatic expansion valves and a method of joining an insulated power element to the valve body of the bulbless thermostatic expansion valve.

BACKGROUND OF THE INVENTION

A thermostatic expansion valve (TEV) is a component of a vapor compression system (for example, a residential air conditioner system) that is used for refrigerant expansion and cooling. The flow control of refrigerant by a TEV conventionally is achieved by sensing the temperature of the suction line via a bulb that is mechanically coupled to the suction line. The actuator portion of the TEV (away from the pin and port) is referred to as the power element which is fluidly connected to the sensing bulb using a metallic capillary tube. The sensing bulb is charged with refrigerant, which expands or contracts with changes in temperature and pressure. A change in temperature and pressure is communicated to the power element via the capillary tube. The changes in pressure cause a welded diaphragm to move within the power element, which in turn exerts force on the pin to move closer or away from a port, thus opening or closing the valve. The control achieved using a pressure-temperature (P-T) relationship is referred to as superheat control, which is an adjustable feature within a TEV by a spring and an adjustable mechanism provided at a lower section of the valve.

As an alternative to the conventional TEV that senses using a bulb, bulbless TEVs have been developed for use in a vapor compression system, with bulbless TEVs being particularly suitable for residential air conditioner systems due to their more compact size and ease of installation. In general, a bulbless TEV does not utilize an external thermostatic sensing bulb with a corresponding external capillary tube to sense temperature in the system at the refrigerant suction line, and thus all of the sensing fluid may be contained in a closed thermodynamic system in the sensor enclosure. The elimination of the bulb eliminates issues associated with poor attachment of the bulb on the suction line, which typically is accomplished with a metallic clamp often resulting in discontinuous contact with the suction line and results in the valve failing to control superheat as intended. The corresponding elimination of the capillary tube also eliminates issues with capillary tube breakage or charge migration in the capillary tube, such as due to condensation in the capillary tube. In addition, a bulbless configuration provides a relatively short path between the suction line and the power element, and thus issues such as clogging, unwanted cooling, and other deficiencies due to longer pathway are minimized.

In conventional bulbless TEVs, the power element typically is connected to the TEV valve body by a threaded joint. An O-ring creates a seal between the valve body and the power element. Other TEVs join the lower housing of the power element to the valve body by a brazed joint, which also requires additional sealing. Traditional methods of joining the power element to the valve body are complex and time consuming, and may require additional sealing elements.

SUMMARY OF THE INVENTION

An aspect of the present application is a bulbless thermostatic expansion valve (TEV) that provides enhanced joining of the power element to the TEV valve body as compared to conventional configurations. The enhanced joining is provided by deforming or crimping an end of an upper extension of the valve body to form a lip relative to an opposing surface of the valve body. The lip and the opposing surface of the valve body define a recess that receives a portion of the power element, such as an end portion of a lower housing of the power element. The power element may be joined to the valve body by placing the lower housing of the power element on the valve body around the upper extension of the valve body. Once the lower housing of the power element is so positioned, the upper extension of the valve body is deformed or crimped to form the lip defining a recess with the opposing upper surface of the valve body, and the lip is crimped tightly and robustly over the end portion of the lower housing such that the lower housing becomes secured within the recess by the crimping operation. The end of the upper extension of the valve body may be roll formed to form the lip, i.e., the end of the upper extension of the valve body may be deformed or crimped using a roll forming process to form the lip.

In an exemplary embodiment, a thermostatic spacer and an O-ring first are positioned on the valve body around the upper extension of the valve body. The lower housing of the power element is then placed on the thermostatic spacer and O-ring and around the upper extension of the valve body. Once the lower housing of the power element is so positioned on the thermostatic spacer and O-ring, the end of the upper extension of the valve body is deformed or crimped, such as by roll forming, to form the lip that defines the recess, and the lower housing of the power element becomes secured within the recess against the thermostatic spacer and O-ring, thereby joining the power element to the valve body.

Accordingly, an aspect of the present application provides a TEV that does not utilize an external thermostatic sensing bulb with a corresponding external capillary tube to sense temperature in the system, such as the temperature of the refrigerant suction line. The thermostatic expansion valve is thus devoid of a sensing bulb and external capillary tube, and thus all of the sensing fluid is contained in a closed thermodynamic system in the sensor enclosure. In addition, the power element is securely joined to the valve body using the lip formed in the end of the upper extension of the valve body. The portion of the power element that is secured to the valve body by formation of the lip may be a lower housing of the power element. The lip may be roll formed, i.e., the upper extension of the valve body may be deformed or crimped using a roll forming process to form the lip. A lip joint, such as a roll formed joint, has been shown to be a robust and reliable low-cost solution for joining the power element to the TEV valve body as compared to conventional furnace brazing or threaded joints. By using such a lip joint, the power element is non-removable and non-replaceable to provide a permanent connection. Another advantage of a roll formed lip joint is that the TEV valve body and the components of the power element are not subjected to thermostatic stress that is typical in a furnace brazing operation, thus increasing the reliability of materials.

An aspect of the application, therefore, is a bulbless thermostatic expansion valve having enhanced joining of the power element to the valve body. In exemplary embodiments, a bulbless thermostatic expansion includes a valve body having an inlet and an outlet; a valve member movable relative to the valve body for controlling flow of an operating fluid through the valve body; a power element including a housing and a diaphragm positioned within the housing, the diaphragm having a first side operatively coupled to the valve member and a second side opposite the first side; and a thermostatic sensor including a sensor enclosure operatively mounted to the power element, wherein a portion of the sensor enclosure together with a portion of the second side of the diaphragm forms a sensing chamber in which a sensing fluid is contained. Changes in the temperature of the sensing fluid results in changes in pressure applied to the second side of the diaphragm, thereby causing movement of the diaphragm which provides movement of the valve member operatively coupled to the first side of the diaphragm. The valve body includes an upper extension that extends from a main body portion, an end of the upper extension being crimped into a lip relative to an opposing surface of the main body portion thereby defining a recess that receives a portion of the housing of the power element to join the power element to the valve body.

In an exemplary embodiment, the lip is formed by roll forming the end of upper extension of the valve body.

In exemplary embodiments of the bulbless thermostatic expansion valve, the housing of the power element is a multipart housing including an upper housing and a lower housing, with the diaphragm being secured between the upper housing and the lower housing, and an end of the lower housing is the portion of the housing of the power element that is received within the recess. The bulbless thermostatic expansion valve further may include a thermostatic spacer positioned on the upper surface of the main body portion of the valve body and around the upper extension of the valve body, and the lower housing is positioned on the thermostatic spacer opposite from the upper surface of the main body portion of the valve body. The bulbless thermostatic expansion further may include an O-ring positioned on the upper surface of the main body portion of the valve body and around the upper extension of the valve body, the O-ring being positioned radially inward relative to the thermostatic spacer.

Another aspect of the application is method of assembly of a bulbless thermostatic expansion valve having enhanced joining of the power element to the valve body. In exemplary embodiments, the method of assembly includes positioning a portion of the housing of the power element around an upper extension of the valve body that extends from a main body portion of the valve body, and crimping an end of the upper extension of the valve body to form a lip relative to an opposing surface of the main body portion of the valve body, thereby defining a recess in which the portion of the housing of the power element is positioned whereby forming the lip joins the power element to the valve body. In an exemplary embodiment, an end of the lower housing is the portion of the housing of the power element that is positioned around the upper extension of the valve body. The method of assembly may include roll forming the end of the upper extension of the valve body to form the lip.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DESCRIPTION

Figure 1:
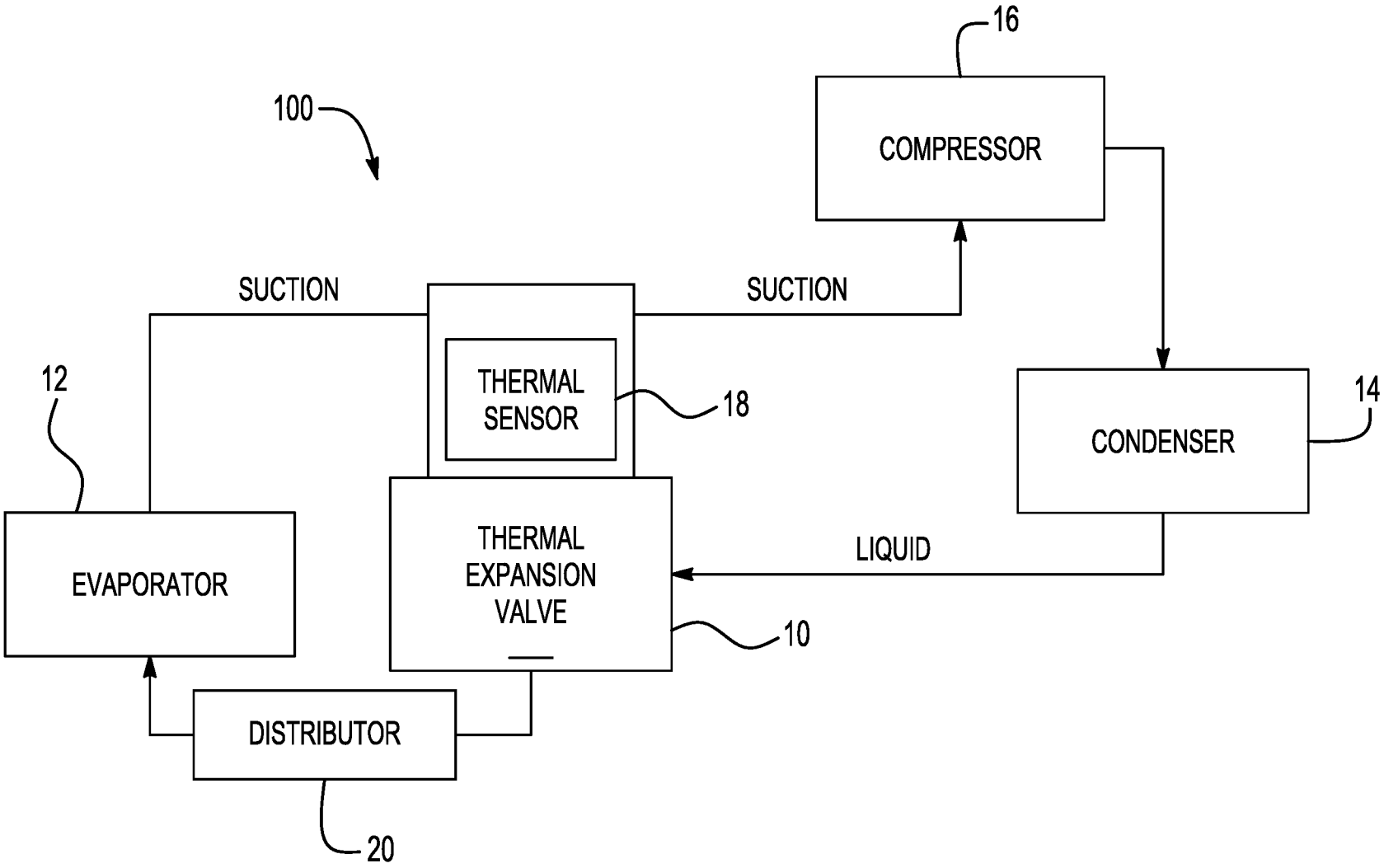
FIG. 1 is a drawing depicting a schematic diagram of an exemplary vapor compression system incorporating a bulbless TEV according to an embodiment of the present application.

Embodiments of the present application will now be described with reference to the drawings, wherein like reference numerals are used to refer to like elements throughout. It will be understood that the figures are not necessarily to scale.

FIG. 1 is a drawing depicting a schematic diagram of an exemplary vapor compression system 100 incorporating a bulbless thermostatic expansion valve (TEV) 10. The vapor compression system 100, for example, may be a residential air conditioning system, or a residential split reversible heat pump/air conditioning system that can perform both heating and cooling. The vapor compression system 100 includes an evaporator 12 contained within a space that is to be cooled, a condenser 14 that is located outside of the cooled space, a compressor 16 positioned between the evaporator outlet and the condenser inlet, and the TEV 10 located downstream of the condenser and upstream of the evaporator. The TEV includes a thermostatic sensor 18 for sensing the temperature of the refrigerant.

A refrigerant circulating through the system is compressed by the compressor which raises the temperature and pressure of the refrigerant. The then hot pressurized refrigerant gas flows through the condenser which serves as a heat exchanger to allow the refrigerant to dissipate heat. The condenser lowers the refrigerant temperature such that the refrigerant condenses into a liquid. The liquid refrigerant then flows through the TEV 10 which serves as a refrigerant modulating valve configured to control flow of the compressed and liquified refrigerant from the condenser to the evaporator. The TEV 10 is configured such that the liquid refrigerant enters the inlet of the TEV and moves from a high pressure zone into a low pressure zone, thus expanding and evaporating some of the refrigerant, and thereby becoming cold. The cold liquid-vapor refrigerant passes through the outlet downstream of the TEV 10 into circuits of the evaporator via a distributor 20, thus absorbing heat from inside the space that is to be cooled. The evaporator could be located, for example, in the plenum of a forced air residential or commercial air conditioning system through which air is blown for cooling the interior of the residence or building. The cold liquid-vapor mixture absorbs heat from the evaporator thereby returning the refrigerant to a gaseous vapor state. The refrigerant vapor is then returned to the compressor through a suction line and the cycle repeats.

Figure 2:
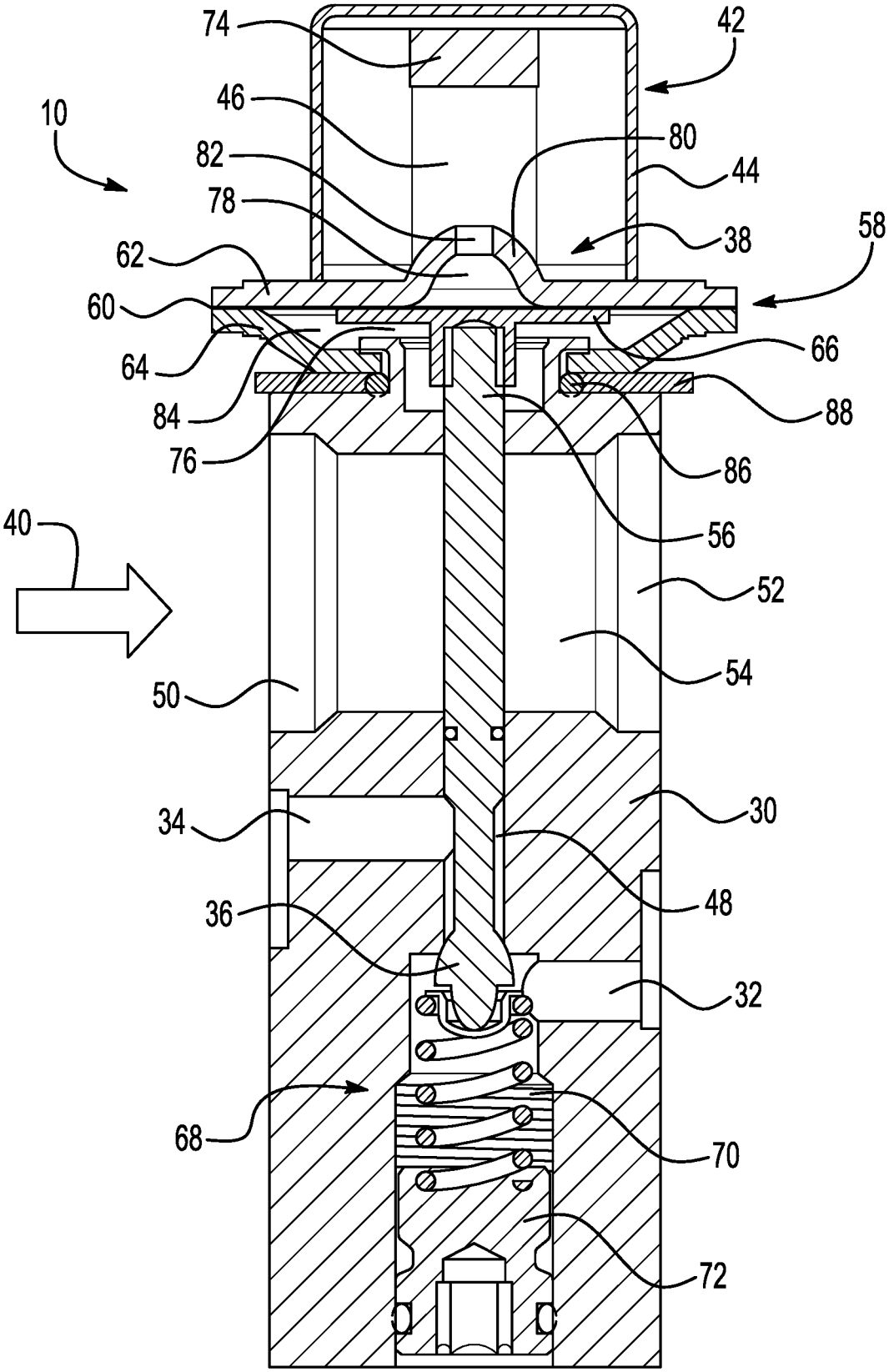
FIG. 2 is a drawing depicting a cross-sectional view of an exemplary embodiment of a bulbless TEV according to an embodiment of the present application.

FIG. 2 is a drawing depicting a cross-sectional view of an exemplary embodiment of the bulbless TEV 10. The TEV 10 includes a valve body 30 having an inlet 32 and an outlet 34. The valve body 30 houses a valve member 36 that is coupled to a power element 38 for controlling operation of the valve member to thereby control flow of operating fluid through the valve body 30. The TEV is coupled to an operating line 40, such as for example a suction line, of the vapor compression system.

The TEV 10 includes a thermostatic sensor 42 operatively mounted to the power element 38, and the thermostatic sensor 42 includes a sensor enclosure 44 that at least partially forms a sensing chamber 46 that contains a sensing fluid. In the illustrated embodiment, the valve body 30 is constructed whereby the inlet 32 is configured to receive operating fluid in the form of liquid downstream of the condenser. The valve member 36 is movable relative to the valve body 30 in response to actuation by the power element 38 to thereby control operating fluid flow through a flow path 48 from the inlet 32 to the outlet 34. The power element 38 may modulate the valve member 36 to modulate fluid flow control and cause expansion of the operating fluid (e.g., liquid refrigerant) across the valve member 36 causing the operating fluid to expand and cool. The expanded liquid-vapor mixture of the operating fluid then exits the outlet 34 of the valve body 30 and passes downstream such as to the evaporator (see FIG. 1) for cooling an area in the manner described above.

As shown in the cross-sectional view of FIG. 2, the valve body 30 includes a second inlet 50, a second outlet 52, and a second fluid passage 54 for flow of operating fluid between the second inlet and second outlet. In the illustrated embodiment, the second inlet 50 is connected to the outlet of the evaporator for receiving operating fluid vapor which passes through the passage 54 and out of the second outlet 52 for fluid being received by the compressor. As such, the valve body is constructed such that the second passage 54 forms a segment of the suction line 40. As shown, the valve body 30 may be constructed to provide a relatively short path from the suction line 40, i.e., via passage 54, to the power element 38 to improve responsiveness and control of the TEV 10.

The valve member 36 may have any suitable valve structure, such as for example a poppet valve or pin that can seat against a valve seat for opening, closing, or modulating flow through the flow path 48. In the illustrated embodiment, the valve member 36 includes an elongated stem portion that extends through the valve body 30 across the flow path 54 to an opposite (e.g., upper) end portion 56 of the valve member 36. The end portion 56 of the valve member may include suitable abutments or stops, such as shoulder portions or the like.

The power element 38 includes a multipart housing 58 and a diaphragm 60 that is fixed in position by the multipart housing 58. The multipart housing 58 includes an upper housing 62 overlying the diaphragm 60, and a lower housing 64 underlying the diaphragm 60. The multipart housing 58 is configured to hold the diaphragm 60 in position, such as by sandwiching an outer peripheral portion of the diaphragm 60 between the upper housing 62 and the lower housing 64. The diaphragm 60 may be fixedly attached, such as by welding or otherwise adhering, portions of the diaphragm 60 to the multipart housing 58.

The diaphragm 60 is operatively coupled to the valve member 36, such as being directly or indirectly attached to a first side (e.g., underside) of the diaphragm 60. The diaphragm 60 may have any suitable structure and be made of any suitable material for enabling movement of the valve member 36 in response to force applied to the diaphragm 60. For example, the diaphragm 60 may be made of a thin sheet or sheets of material that are configured to flex or bow in response to a force applied to the diaphragm 60, as described in further detail below. The diaphragm 60 may be made of a suitable material, such as metal, which is impermeable to liquid or gas. To enhance the flexing of the diaphragm 60, the upper end 56 of the valve member 36 may include or be fitted with a pressure pad 66. An upper surface of the pressure pad 66 is a widened and flat surface that underlies the diaphragm 60 to distribute the forces imparted between the valve member 36 and the diaphragm 60.

The thermostatic sensor 42 of the TEV 10 is operatively mounted to, or integrated with, the multipart housing 58 of the power element 38, although the thermostatic sensor 42 also could be integrated with or operatively mounted to the valve body 30. In this manner, the sensor enclosure 44 may be supported by the valve body 30, or the valve body 30 may be supported by the sensor enclosure 44. In the illustrated embodiment of FIG. 2, for example, the sensor enclosure 44 is in the form of a dome mounted atop the power element 38 and which is directly attached to the upper housing 62 of the multipart housing 58 of the power element 38. The diaphragm 60 of the power element 38 serves as a partition that together with at least a portion of the sensor enclosure 44 forms and encloses the sensing chamber 46 to contain the sensing fluid. In exemplary embodiments, the sensor chamber 46 is formed as a closed thermodynamic system in which there is no mass flow into or out of the sensor chamber 46 during operation of the TEV. In this manner, the sensor enclosure 44 may be attached to the upper housing 62 of the power element 38 with a suitable connection, such as a gas impermeable weld. The TEV 10 is configured such that changes in temperature of the sensing fluid in the sensing chamber 46 results in contraction or expansion of the sensing fluid which changes the pressure in the sensing chamber 46, and therefore the force applied to the diaphragm 60 of the power element 38. The changes in pressure cause the diaphragm 60 to move (e.g., flex or bow), which in turn exerts force on the valve member 36 to further open or further close the TEV 10. As shown, the TEV 10 may further include an adjustment mechanism 68, such as a spring-biased adjuster including a spring 70 and threaded pin 72, whereby the spring force combines with fluid pressure at the underside of that diaphragm for counteracting the pressure from the sensing chamber 46 and thereby setting a desired control setpoint of the TEV 10.

The sensing fluid charged into the sensing chamber 46 may be any suitable fluid, such as a gas that can expand or contract in response to temperature changes. In exemplary embodiments, the sensing fluid is a refrigerant, which may be the same type or different type of refrigerant as the operating fluid. The sensing chamber 46 also may contain a ballast material 74, although in some applications a ballast material 74 is not required. The ballast material 74 may be any suitable ballast, such as a porous ceramic block or beads that adsorbs/desorbs the sensing fluid. The ballast material 74 can slow how fast the temperature and the related pressure in the sensing chamber 46 changes. This slows down the reactivity of the TEV 10 and stabilizes the output of the valve during operation. The amount and the type of ballast material 74 can be tailored to attain a specific superheat control desired.

In exemplary embodiments, the TEV 10 is configured such that heat energy transfers across the diaphragm 60 between the sensing fluid in the sensing chamber 46 that is in communication with the first (upper) side of the diaphragm and a region in communication with the second (under) side of the diaphragm 60. The region at the opposite second side of the diaphragm 60 may be in communication with an operating line of the system such that the temperature of the operating fluid communicates with the sensing fluid in the sensing chamber 46 across the diaphragm 60. In this manner, the region at the opposite (under) side of the diaphragm 60 may be an open thermodynamic system including mass and heat flow. In exemplary embodiments, a fluid flow passage 76 is provided to fluidly connect the operating line 40, such as the suction line, to the region at the second (under) side of the diaphragm 60. The changes in temperature of the sensing fluid in the sensing chamber 46 resulting from the exchange of heat energy results in increasing or decreasing the pressure in the sensing chamber 46, and thus the force generated at the first (upper) side of the diaphragm 60. The region at the opposite (under) side of the diaphragm 60 (e.g., in fluid communication with the operating line 40) exerts an opposite force to the second (under) side of the diaphragm 60. The diaphragm 60 of the power element 38, and thereby the valve member 36, move in response to the pressure differentials on the opposite sides of the diaphragm 60.

In exemplary embodiments, the configuration of the multipart housing 58 of the power element 38 enables improved control of the TEV 10. For example, as shown in the illustrated embodiment, the multipart housing 58 is constructed to hold the radially outer peripheral portion of the diaphragm 60 to constrain movement of the diaphragm 60. The first (upper) housing 62 and/or the second (lower) housing 64 of the multipart housing 58 may extend radially inwardly to further constrain flexure of the diaphragm 60 as may be desired. As shown, a radially inward portion of the upper housing 62 may be closely arranged to the upper side of the diaphragm and may slightly taper upwardly toward center to permit a desired amount of flexure of the diaphragm 60. A radially inward portion of the lower housing 64 also may be constructed to permit a desired amount of flexure of the diaphragm 60. The upper side communicating with the sensing chamber 46 may be closer than the opposite side, as shown, to permit more downward flexure than upward flexure of the diaphragm 60.

To provide suitable fluid communication with the sensing chamber 46 and/or a desired amount of fluid pressure at the upper side of the diaphragm 60, the first (upper) housing 62 of the multipart housing 58 may be configured to provide a first (e.g., upper) chamber 78 formed by at least a portion of the first (upper) housing 62 of the multipart housing 58 together with at least a portion of the upper side of the diaphragm 60. In the illustrated embodiment, a dome-shaped protrusion 80 forms at least part of the upper chamber 78 and includes an orifice 82 for providing fluid communication with the sensing chamber 46.

To provide suitable fluid communication with the underside of the diaphragm 60, the second (lower) housing 64 of the multipart housing 58 may be configured to provide a second (e.g., lower) chamber 84 formed by at least a portion of the second (lower) housing 64 together with at least a portion of the underside of the diaphragm 60. In this manner, the diaphragm 60 serves as a divider that divides the internal chamber of the multipart housing 58 into the first (e.g., upper) chamber 78 and the second (e.g., lower) chamber 84, and is configured to permit transfer of heat energy but restrict transfer of fluid from the sensing chamber 46 and upper chamber 78 to the lower chamber 84. As shown, the lower housing 64 of the multipart housing 58 may provide a seat or stop for the upper portion 56 of the valve member 36 to control the valve member movement. A suitable seal 86, such as an O-ring seal, may be arranged between the valve body 30 and the power element 38 to provide a suitable seal.

As noted above, the region at the underside of the diaphragm 60 (e.g., the lower fluid chamber 84) may be fluidly connected to an operating line of the system via the fluid flow passage 76 so that the TEV 10 is reactive to adjust the valve member 36 in response to temperature and pressure of the operating fluid flowing through the operating line. In the illustrated embodiment, the operating line is the suction line 40, 54 in which operating fluid (e.g., refrigerant vapor) is routed through the passage 76 which is formed in part as an internal passage in the valve body 30. As shown, the passage 76 may be formed at least partially by a vertical bore that contains the upper portion 56 of the valve member 36. The passage 76 connected to the suction line 40 of the system also may be referred to as an internal equalization passage or equalization line. The fluid (e.g., refrigerant vapor) may flow through the passage 76 into the chamber 84 to be in direct contact with the diaphragm 60 and permit heat energy transfer across the diaphragm 60 with the sensing fluid in the sensing chamber 46 via upper chamber 78. The diaphragm 60 may be a heat conductive material, such as metal, to facilitate such heat transfer. The power element 38 is responsive to forces acting on opposite sides of the diaphragm 60 via pressure changes in each of the lower 84 and upper 78/46 chambers to thereby adjust position of the valve member 36 and control flow between inlet 32 and outlet 34.

In some cases, outside temperature influences on the sensing fluid in the sensing chamber 46, other than that transferred through the diaphragm 60, could affect the reactivity and control of the TEV 10. As such, in exemplary embodiments, it may be beneficial to thermostaticly isolate the enclosure 44 of the sensing chamber 46 in one or more ways. For example, in exemplary embodiments, the sensor enclosure 44 is spaced apart from one or more, or all, operating lines of the system, such as the suction line 40 which may contain hot evaporated refrigerant. The sensor operates to measure the temperature of the suction line, and the body material is affected by the mix of ambient effects, liquid into the valve, suction fluid out of the valve, and suction vapor into the valve (upper chamber). Sensor spacing may be accomplished, for example, by arranging the sensor enclosure 44 to not intersect with a flow path of operating fluid flowing through the valve body, with the suction flow traveling to the diaphragm of the power element to get an accurate measurement of the temperature. In FIG. 2, for example, the sensor enclosure 44 is operatively mounted to the valve body 30 such that the multipart housing 58 of the power element 38 is arranged between the enclosure 44 and the valve body 30. The operating fluid flows through passages 48 and 54 and thus does not intersect with the enclosure 44, but instead provides heat transfer with the sensing chamber 46 via the flow passage 76 and diaphragm 60 in the manner described above. Such a configuration can reduce the reactivity of the TEV 10, which may be useful to prevent overshooting or hunting phenomena.

To further isolate the enclosure 44 and sensing chamber 46 from unwanted heat transfer, a thermostatic spacer 88 may be arranged between the lower housing 64 of the power element 38 and the operating line (e.g., 40). The thermostatic spacer 88 may be made from any suitable material in any suitable form that reduces heat transfer (e.g., conduction) between the two members, and more specifically, may be designed to reduce reactivity of the TEV 10 by thermostaticly insulating the sensing chamber 46. For example, the thermostatic spacer 88 may be in the form of a thermostatic insulator made from a suitable thermostaticly insulative material having a low thermostatic conductivity (e.g., less than 50 W/mK; more particularly less than 10 W/mK; or less than 1.0 W/mK; or less than 0.50 W/mK, such as in a range from 0.01-50 w/mK, for example). Non-limiting examples of such thermostaticly insulative materials may include, for example, polymers (e.g., nylon, PEEK, PTFE, silicone, etc.), glass (e.g., fiberglass), ceramics (e.g., alumina, silica, etc.), minerals (e.g., mineral wool), foams, or the like. Alternatively or additionally, the thermostatic spacer 88 may be formed as a structure with an increased thickness to reduce heat conduction. Such a thermostatic spacer with increased thickness may or may not be an insulative material, but instead may be a thermostaticly conductive material (such as metal) having sufficient thickness to reduce heat transfer to the sensing chamber 46. In the illustrated embodiment in which the operating line is formed by part of the valve body 30, the thermostatic spacer 88 is formed as an insulative spacer that is arranged between the lower housing 64 of the power element 38 and the valve body 30. This positioning restricts heat transfer from the valve body 30 and improves the control of the TEV 10.

The bulbless configuration of the TEV 10 provides numerous advantages over conventional configurations that use a bulb. For example, valve body 30 incorporating the suction line 40, 54 facilitates assembly of the TEV into the system. The TEV 10 may also be lower cost because it contains fewer parts. The thermostatic coupling of the suction line to the sensor chamber 46 via the flow passage 76 allows for elimination of the bulb and capillary tube in conventional TEV installations and the problems associated therewith. For example, the elimination of the bulb eliminates issues associated with poor attachment of the bulb on the suction line, which is typically accomplished with a metallic clamp often resulting in discontinuous contact with the suction line and results in the valve failing to control superheat as intended. The TEV 10 with the thermostatic sensor 42 as described provides more predictable thermostatic communication than prior bulb designs. The elimination of the capillary tube also eliminates issues with capillary tube breakage or charge migration in the capillary tube (condensation in the capillary tube). In addition, the equalizer line (passage 76) is used to sense pressure of the suction line 80, and by providing a relatively short path between the suction line and power element 38, issues such as clogging and unwanted cooling, may be minimized.

Figure 3:
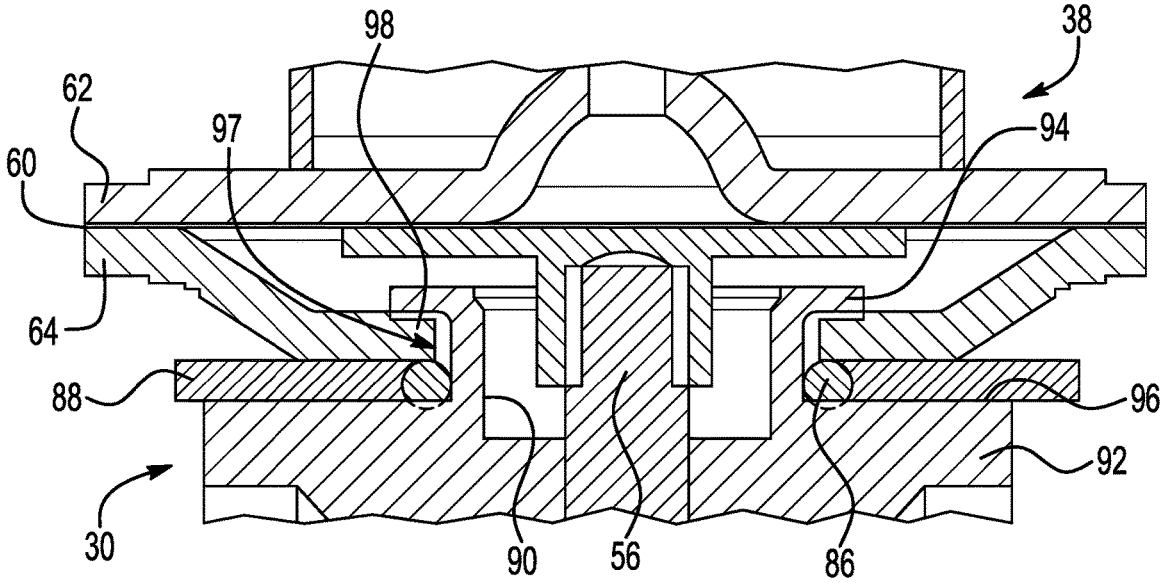
FIG. 3 is a drawing depicting a close-up view of a portion of the TEV of FIG. 2 to illustrate the manner of joining of the power element to the valve body.

FIG. 3 is a drawing depicting a close-up view of a portion of the TEV 10 to illustrate the manner of joining of the power element 38 to the valve body 30. Certain reference numerals of FIG. 2 are not indicated in FIG. 3 to provide a clearer illustration of the joining elements. As referenced above, traditional methods of joining the power element to the valve body in a TEV are complex and time consuming, and may require additional sealing elements. In view of the deficiencies of conventional TEVs, the configuration of TEV 10 of the present application provides enhanced joining of the power element 38 to the TEV valve body 30 as compared to conventional configurations. Referring to the close-up view of FIG. 3, the valve body 30 includes an upper extension 90 that extends from a main body portion 92 of the valve body 30. As seen in the depiction of FIG. 3, the upper extension 90 may be positioned concentrically and radially outward relative to the upper portion 56 of the valve member 36. The upper extension 90 further may be centrally located relative a longitudinal axis of the main body portion 92.

The enhanced joining of the power element 38 to the valve body 30 is provided by deforming or crimping an end of the upper extension 90 of the valve body 30 to form a lip 94 relative to an opposing upper surface 96 of the main body portion 92 of the valve body. The lip 94 and the opposing upper surface 96 of the main body portion 92 of the valve body thus define a recess 97 that receives a portion of the housing of the power element 38, such as an end portion of the lower housing 64 of the multipart housing 58 of the power element 38. The power element may be joined to the valve body by placing the lower housing 64 of the power element on the upper surface 96 and around the upper extension 90 of the valve body 30. Once the lower housing of the power element is so positioned, the end of the upper extension 90 of the valve body is deformed or crimped to form the lip 94, such that the lip 94 and opposing upper surface 96 define the recess in which the end portion of the lower housing 64 is now situated. The crimping operation results in a tight and robust interaction of the lip against the lower housing of the power element, and in this manner, the lower housing becomes robustly and tightly secured within the recess by the crimping operation. The end of the upper extension 90 of the valve body may be roll formed to form the lip 94, i.e., the end of the upper extension of the valve body may be deformed or crimped using a roll forming process to form the lip.

In an exemplary embodiment that includes the thermostatic spacer 88 and the O-ring 86, the thermostatic spacer and the O-ring first are positioned on the upper surface 96 and around the upper extension 90 of the valve body, with the O-ring being positioned radially inward relative to the thermostatic spacer. The thermostatic spacer 88 may be retained in place using any suitable fastening element, and one or more dowel pins provides a suitable example manner for retaining the thermostatic spacer in place, which in turn operates to secure retention of the O-ring 86. The lower housing 64 of the power element is then placed on the thermostatic spacer 88 and O-ring 86 and also around the upper extension 90 of the valve body. Once the lower housing of the power element is so positioned on the thermostatic spacer and O-ring, the end of the upper extension of the valve body is deformed or crimped as referenced above, such as by roll forming, to form the lip 94 defining the recess with the opposing upper surface 96, and then the lower housing becomes secured by the crimping (roll forming) operation within the recess against and along with the thermostatic spacer and O-ring.

Figure 4:
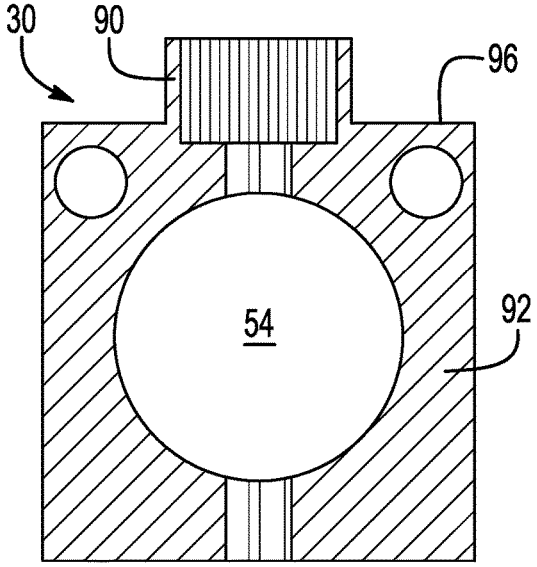
FIG. 4, FIG. 5, FIG. 6, and FIG. 7 constitute a series of drawings depicting a method of valve assembly including a progression of steps to join the power element to the valve body in a robust and secured fashion for assembling the TEV.

FIGS. 4-7 depict a method of valve assembly including a progression of steps to join the power element to the valve body for assembling a TEV. FIG. 4 illustrates the valve body 30 in isolation. As described above, the valve body 30 includes a main body portion 92 having an upper surface 96, and an upper extension 90 that extends from the main body portion 92. The main body portion defines the fluid passage 54 that is part of the suction line through the TEV. Other portions of the TEV, such as the valve member, are omitted from these figures for simplicity of illustration of the method of assembly of the TEV. Accordingly, a first step of the method of valve assembly is to provide a valve body as shown in FIG. 4, along with the valve member and related components that are housed within the valve body.

In general, the method of valve assembly includes positioning a portion of the housing of the power element around the upper extension of the valve body that extends from the main body portion of the valve body, and crimping an end of the upper extension of the valve body to form a lip relative to an opposing surface of the main body portion of the valve body, thereby defining a recess in which the portion of the housing of the power element is positioned to join the power element to the valve body in a secured and robust fashion. In exemplary embodiments, the lip is formed by roll forming the end of the upper extension of the valve body. In exemplary embodiments, an end of the lower housing is the portion of the housing of the power element that is positioned around the upper extension of the valve body. Generally, the end of the lower housing first is positioned around the upper extension of the valve body and subsequently the diaphragm and the upper housing are fixed to the lower housing.

Figure 5:
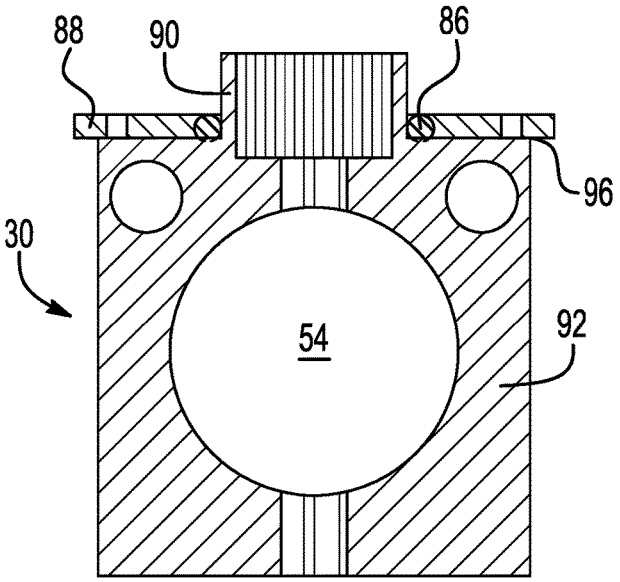

In embodiments that include the thermostatic spacer and the O-ring, prior to positioning the end of the lower housing of the power element around the upper extension of the valve body, the thermostatic spacer is positioned on the upper surface of the main body portion of the valve body and around the upper extension of the valve body. After the thermostatic spacer is positioned, the lower housing is positioned on the thermostatic spacer opposite from the upper surface of the main body portion of the valve body. In addition, prior to positioning the lower housing of the power element around the upper extension of the valve body, the O-ring is positioned on the upper surface of the main body portion of the valve body and around the upper extension of the valve body radially inward relative to the thermostatic spacer The following figures illustrate such method steps corresponding to an embodiment including the thermostatic spacer an O-ring, but again such elements are optional. FIG. 5 thus illustrates a second step of the method of valve assembly after providing the valve body as shown in FIG. 4, illustrating placement of a thermostatic spacer and O-ring. The O-ring 86 and the thermostatic spacer 88 are placed on the upper surface 96 and around the upper extension 90 of the valve body, with the O-ring 86 being positioned radially inward relative to the thermostatic spacer 88. The O-ring 86 may be in direct contact with an outer surface of the upper extension 90.

Figure 6:
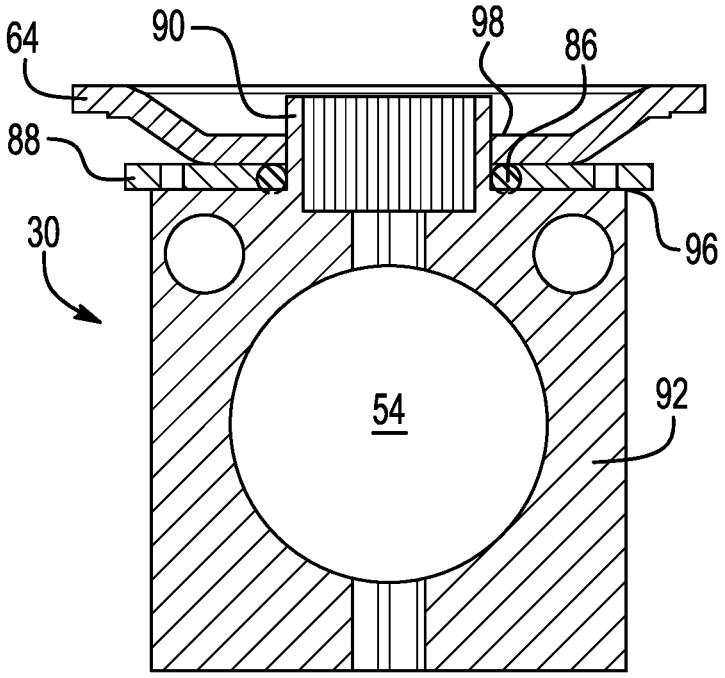

FIG. 6 illustrates a third step of the method of valve assembly illustrating placement of the power element in position relative to the valve body. As shown in FIG. 6, a portion of the housing of the power element, such as the lower housing 64 of the power element, is placed on the O-ring 86 and thermostatic spacer 88, and around the upper extension 90 of the valve body. An end portion 98 of the lower housing 64 is thereby positioned adjacent to or directly against the outer surface of the upper extension 90.

Figure 7:
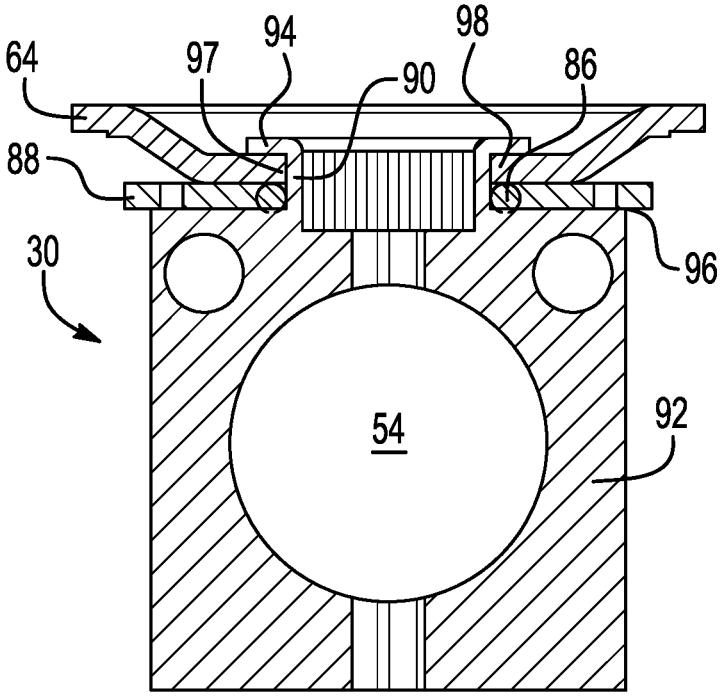

FIG. 7 illustrates a fourth step of the method of valve assembly illustrating the deforming or crimping of an end of the upper extension of the valve body to form the recess 97 that joins the power element to the valve body. In particular, the end of the upper extension 90 is crimped or deformed radially outward to form the lip 94, and the lip 94 and the upper surface 96 of the main body portion of the valve body define the recess 97 in which the end portion 98 of the lower housing 64 of the power element is situated. The O-ring 86 and the thermostatic spacer 88 also are situated in part within the recess 97 between the end portion 98 of the lower housing 64 and the upper surface 96 of the valve body 30. The crimping operation presses the lip 94 robustly and tightly against the lower housing 64 to provide a secured fit of the lower housing 64 (and also the O-ring and thermostatic spacer) within the recess 97. The crimping operation thus results in a tight and robust interaction of the lip against the lower housing of the power element, and in this manner, the lower housing becomes joined in a robust and secured fashion within the recess by the crimping operation. In an exemplary embodiment, the crimping operation is a roll forming process by which the end of the upper extension 90 is roll formed to form the lip 94. In FIGS. 6 and 7, only the lower housing 64 of the power element is shown for simplicity. In one example, prior to crimping or roll forming the upper extension to form the lip, only the lower housing is placed about the valve body, and other components of the power element 38 (such as the diaphragm 60 and upper housing 62) and the thermostatic sensor 42 are secured to the lower housing after the crimping operation is performed.

Figure 8:
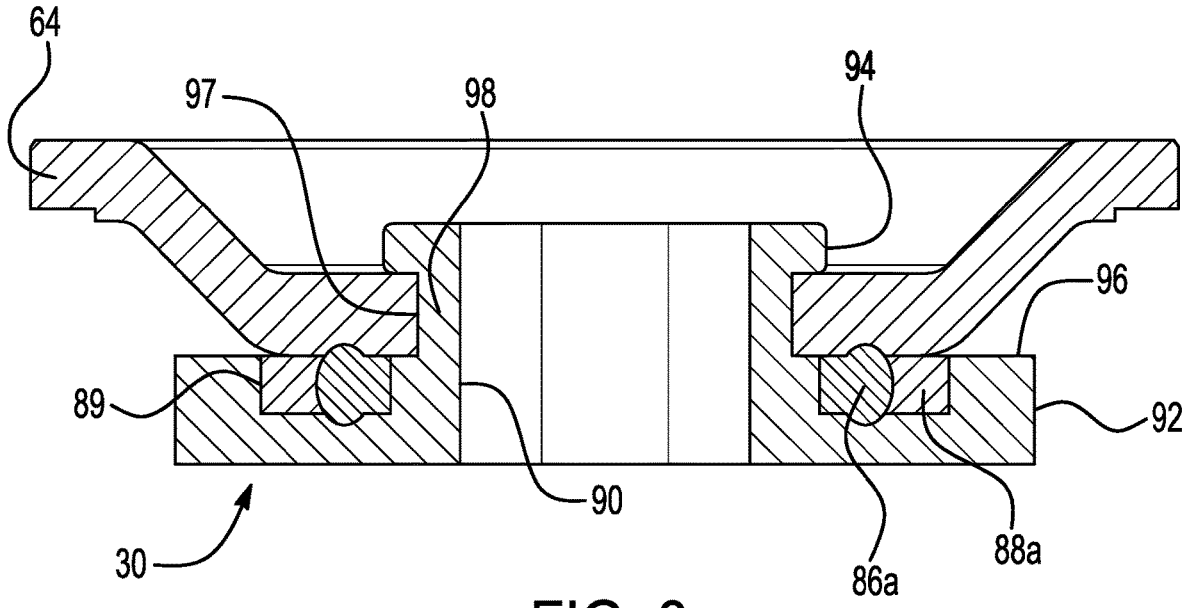
FIG. 8 is a drawing depicting a portion of the close-up view of the TEV portion of FIG. 3 to illustrate an alternative configuration of incorporating the thermostatic spacer and O-ring into the valve body.

FIG. 8 is a drawing depicting a portion of the close-up view of the TEV portion of FIG. 3 to illustrate an alternative configuration of incorporating the thermostatic spacer and O-ring into the valve body. Certain components are omitted from the depiction of FIG. 8 for clarity of illustration. In the example of FIG. 8, the upper surface 96 of the main body portion 92 of the valve body has a recess 89 that receives an O-ring 86*a* and a thermostatic spacer 88*a*. For applications involving relatively higher pressures, the recess 89 holds the thermostatic spacer 88*a* in place for enhanced support and retention of the O-ring 86*a*, as compared to, for example, dowel pins as may be used in the previous embodiment. The TEV otherwise may be configured comparably as in the previous embodiment.

In general, the O-ring 86 (86*a*) and the thermostatic spacer 88 (88*a*) may be configured as separate components as illustrated in the figures. The O-ring 86 (86*a*) and the thermostatic spacer 88 (88*a*) may be made of the same or different materials, and/or may have the same or a varying hardness, as may be suitable to provide optimized compressibility and thermal properties for a given application. In another variation, the O-ring 86 (86*a*) and the thermostatic spacer 88 (88*a*) may be a single, integral component. As an integrated component, the combination O-ring thermostatic spacer may be configured as a uniform material, or the combination O-ring thermostatic spacer may be configured as co-molded or otherwise co-formed different materials, which again may have the same or a varying hardness as may be suitable to provide optimized compressibility and thermal properties for a given application.

The thermostatic expansion valve of the present application is thus devoid of a sensing bulb and external capillary tube, and thus all of the sensing fluid may be contained in a closed thermodynamic system in the sensor enclosure. In addition, the power element is securely joined to the valve body using the crimped lip formed in the end of the upper extension of the valve body. The lip may be roll formed, i.e., the end of the upper extension of the valve body may be deformed or crimped using a roll forming process to form the lip. A lip joint, such as a roll formed lip joint, has been shown to be a robust and reliable low-cost solution for joining the power element to the TEV valve body as compared to conventional furnace brazing or threaded joints. By using such a crimped or roll-formed lip joint, the power element is non-removable and non-replaceable to provide a permanent connection of the power element to the valve body. Another advantage of a roll formed lip joint is that the TEV valve body and the components of the power element are not subjected to thermostatic stress that is typical in a furnace brazing operation, thus increasing the reliability of materials.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A bulbless thermostatic expansion valve comprising:

a valve body having an inlet and an outlet;

a valve member movable relative to the valve body for controlling flow of an operating fluid through the valve body;

a power element including a housing and a diaphragm positioned within the housing, the diaphragm having a first side operatively coupled to the valve member and a second side opposite the first side; and a thermostatic sensor including a sensor enclosure operatively mounted to the power element, wherein a portion of the sensor enclosure together with a portion of the second side of the diaphragm form a sensing chamber in which a sensing fluid is contained;

wherein changes in the temperature of the sensing fluid results in changes in pressure applied to the second side of the diaphragm, thereby causing movement of the diaphragm which provides movement of the valve member operatively coupled to the first side of the diaphragm; and wherein the valve body includes a main body portion and an upper extension that extends from the main body portion, an end of the upper extension being crimped into a lip relative to an opposing surface of the main body portion thereby defining a recess that receives a portion of the housing of the power element to join the power element to the valve body.

2. The bulbless thermostatic expansion valve of claim 1, wherein the housing of the power element is a multipart housing including an upper housing and a lower housing, with the diaphragm being secured between the upper housing and the lower housing; and an end of the lower housing is the portion of the housing of the power element that is received within the recess.

3. The bulbless thermostatic expansion valve of claim 1, wherein the lip is formed by roll forming the end of the upper extension of the valve body.

4. The bulbless thermostatic expansion valve of claim 1, wherein the upper extension of the valve body is positioned concentrically and radially outward relative to a portion of the valve member.

5. The bulbless thermostatic expansion valve of claim 1, wherein the upper extension of the valve body is centrally located relative to a longitudinal axis of the main body portion of the valve body.

6. The bulbless thermostatic expansion valve of claim 2, further comprising a thermostatic spacer positioned on the upper surface of the main body portion of the valve body and around the upper extension of the valve body, and the lower housing of the power element is positioned on the thermostatic spacer opposite from the upper surface of the main body portion of the valve body.

7. The bulbless thermostatic expansion valve of claim 6, further comprising an O-ring positioned on the upper surface of the main body portion of the valve body and around the upper extension of the valve body, the O-ring being positioned radially inward relative to the thermostatic spacer.

8. The thermostatic expansion valve according to claim 1, wherein the expansion valve is devoid of a sensing bulb and external capillary tube, and the sensing fluid is contained entirely in the sensor enclosure as a self-contained closed thermodynamic system.

9. The thermostatic expansion valve according to claim 1, wherein the sensor enclosure is formed as a dome that is mounted to the power element.

10. The thermostatic expansion valve according to claim 1, wherein the sensor enclosure is adapted to be operatively mounted to a suction line of a refrigerant system, or wherein the valve body includes an internal fluid passage that forms a segment of the suction line.

11. A refrigerant system comprising a compressor, a condenser, an evaporator, and the thermostatic expansion valve according to claim 1.

12. A method of assembly of a bulbless thermostatic expansion valve, wherein the bulbless thermostatic expansion valve comprises a valve body having an inlet and an outlet, a valve member movable relative to the valve body for controlling flow of operating fluid through the valve body, a power element including a housing and a diaphragm positioned within the housing and operatively coupled to the valve member, and a thermostatic sensor including a sensor enclosure operatively mounted to the power element, wherein a portion of the sensor enclosure together with a portion the diaphragm forms a sensing chamber in which a sensing fluid is contained;

the method of assembly comprising:

positioning a portion of the housing of the power element around an upper extension of the valve body that extends from a main body portion of the valve body; and crimping an end of the upper extension of the valve body to form a lip relative to an opposing surface of the main body portion of the valve body, thereby defining a recess in which the portion of the housing of the power element is positioned whereby forming the lip joins the power element to the valve body.

13. The method of assembly of claim 12, wherein the housing of the power element is a multipart housing including an upper housing and a lower housing, with the diaphragm being secured between the upper housing and the lower housing; and an end of the lower housing is the portion of the housing of the power element that is positioned around the upper extension of the valve body.

14. The method of assembly of claim 13, wherein the end of the lower housing of the power element first is positioned around the upper extension of the valve body, and subsequently the diaphragm and the upper housing of the power element are fixed to the lower housing.

15. The method of assembly of claim 12, wherein the lip is formed by roll forming the end of the upper extension of the valve body.

16. The method of assembly of claim 12, wherein the upper extension of the valve body is positioned concentrically and radially outward relative to a portion of the valve member.

17. The method of assembly of claim 12, wherein the upper extension is centrally located relative to a longitudinal axis of the main body portion of the valve body.

18. The method of assembly of claim 13, further comprising, prior to positioning the lower housing of the power element around the upper extension of the valve body, positioning a thermostatic spacer on the upper surface of the main body portion of the valve body and around the upper extension of the valve body; and after the thermostatic spacer is positioned, positioning the lower housing on the thermostatic spacer opposite from the upper surface of the main body portion of the valve body and then crimping the end of the of the upper extension of the valve body to form the lip.

19. The method of assembly of claim 18, further comprising, prior to positioning the lower housing of the power element around the upper extension of the valve body, positioning an O-ring on the upper surface of the main body portion of the valve body and around the upper extension of the valve body radially inward relative to the thermostatic spacer.

20. The method of claim 12, further comprising fixing the thermostatic sensor to the power element.

* * * * *